United States Patent [19]

Kaiser et al.

[11] Patent Number: 4,671,257

[45] Date of Patent: Jun. 9, 1987

[54] CONTINUOUS PASSIVE MOTION EXERCISE APPARATUS

[75] Inventors: Robert T. Kaiser, Elyria; Neal J. Curran, Cleveland; Theodore D. Wakefield, II, Vermillion, all of Ohio

[73] Assignee: Invacare Corporation, Elyria, Ohio

[21] Appl. No.: 693,807

[22] Filed: Jan. 23, 1985

[51] Int. Cl.[4] ..... A61H 1/02

[52] U.S. Cl. ..... 128/25 R; 272/900; 5/60; 5/507; 128/80 C

[58] Field of Search ..... 5/60, 62, 503, 507, 5/508; 128/25 R, 25 B; 272/900, 144; 16/357, 361; 632/20

[56] References Cited

U.S. PATENT DOCUMENTS

| | | | |
|---|---|---|---|
| 1,709,153 | 4/1929 | Pownall . | |
| 1,862,237 | 6/1932 | Pepler | 5/507 X |
| 2,135,018 | 11/1938 | Svensson | 272/80 |
| 2,168,649 | 8/1939 | Johnson | 5/62 |
| 2,183,265 | 12/1939 | Maloney | 272/79 |
| 2,631,582 | 3/1953 | Bensfield | 128/25 |
| 2,777,439 | 1/1957 | Tuttle | 128/25 R |
| 3,046,072 | 7/1962 | Douglass, Sr., et al. | 5/60 X |
| 3,072,400 | 1/1963 | Dykinga | 272/58 |
| 3,612,042 | 10/1971 | Fry | 128/25 R |
| 3,618,595 | 11/1971 | Stahmer et al. | 128/25 R |
| 3,661,149 | 5/1972 | Ferries | 128/25 R |
| 3,683,898 | 8/1972 | Underwood | 128/25 R |
| 3,693,614 | 9/1972 | Schon | 128/25 R |
| 3,834,694 | 9/1974 | Pridgen | 272/58 |
| 4,048,886 | 9/1977 | Zettler | 72/26 |
| 4,185,622 | 1/1980 | Swenson | 128/25 B |
| 4,282,865 | 8/1981 | Pogue | 128/25 R |
| 4,323,060 | 4/1982 | Pecheux | 128/25 R X |
| 4,485,524 | 12/1984 | Neville | 16/361 X |
| 4,487,199 | 12/1984 | Saringer | 128/25 R |
| 4,489,454 | 12/1984 | Thompson | 5/503 |
| 4,492,222 | 1/1985 | Hajianpour | 128/25 R |
| 4,506,661 | 3/1985 | Foster | 128/80 C |
| 4,509,509 | 4/1985 | Bouvet et al. | 128/25 R |
| 4,523,585 | 6/1985 | Lamb | 128/80 C |
| 4,538,595 | 9/1985 | Hajianpour | 128/25 R |
| 4,546,763 | 10/1985 | Coutts | 128/25 R |
| 4,549,534 | 10/1985 | Zagorski | 128/25 R |

FOREIGN PATENT DOCUMENTS

| | | | |
|---|---|---|---|
| 82/02832 | 9/1982 | Canada | 5/60 |
| 521142 | 3/1931 | Fed. Rep. of Germany . | |
| 2524468 | 12/1976 | Fed. Rep. of Germany | 272/144 |

OTHER PUBLICATIONS

Mobilimb TM Ad. Brochure, Danninger Medical.
Dann-Flex 400 Ad. Brochure, Danninger Medical.
Instruction Manual for Model 300, Danni-Flex Continuous Passive Motion Machine, Danninger Med.
Sutter CPM 2000S, Ad. Brochure, Sutter Biomedical Inc., 1984.
OECCK-7, Passive Motion Knee Exerciser Ad. Brochure, Orthopedic Equip. Co.
Stryker Leg Exerciser, Ad. Brochure, Stryker.
Cape System, Ad. Brochure, Zimmer Inc., 1983.

*Primary Examiner*—Richard J. Apley
*Assistant Examiner*—J. Welsh
*Attorney, Agent, or Firm*—Fay, Sharpe, Beall, Fagan, Minnich & McKee

[57] ABSTRACT

A bed (A) has side rails (20, 22) and defines a patient supporting surface (38). A mounting assembly (B) includes a transverse member (50) which is clamped to the bed side rails and an upstanding post (58). A power module mounting bar (70) is slidably positioned on the upstanding post to be mounted thereto in a selectively adjustable vertical position and to be selectively swung about the axis of the post to a storage position. A power module (C) drives a shaft (98) through reciprocating angular displacement at a selectively adjustable speed and between selectively adjustable angular displacement limits. A patient joint flexing assembly (D) is connected with the power module shaft to flex a selected one of the patient's joints under motive force supplied by the power module. Commonly, a plurality of joint flexing assemblies are provided, each particularly adapted for flexing one of the patient's joints, such as a knee flexing assembly, an elbow flexing assembly, and the like. In the knee flexing assembly, a thigh supporting frame portion (174) and a calf supporting frame portion (176) are interconnected by a polycentric hinge (178). In a elbow flexing assembly, a wrist flexing mechanism (220) is provided for flexing the patient's wrist in coordination with flexing of the elbow.

18 Claims, 6 Drawing Figures

CONTINUOUS PASSIVE MOTION EXERCISE APPARATUS

BACKGROUND OF THE INVENTION

The present invention relates to the patient rehabilitation art. The invention finds particular application in the rehabilitation and physical therapy for injured limbs and joints and will be described with particular reference thereto. It is to be appreciated that the invention may find broader applications in other areas of patient rehabilitation, such as recovery from orthopedic surgery, circulatory stimulation, muscle rehabilitation, and the like.

In the past, postoperative and post trauma treatment of patients' joints commonly included immobilization. The affected joints were fixed by casts or traction for an extended duration. During the immobilization, various medical problems commonly arose associated with the immobilized joint and body portions. In particular, capsular, ligamentous, and articular adhesions, thromboembolism, venous stasis, post-traumatic osteopenia, peripheral edema muscle atrophy, and the like were commonly attributed to the immobilization.

These immobilization related medical problems could be reduced or eliminated by early mobilization of the affected joint. It has been found to be advantageous to initiate joint mobilization immediately following orthopedic surgery, in many instances in the operating and recovery rooms while the patient is still under anethesia. Specifically, continuous passive motion of the affected joints have been found to be effective in reducing or eliminating the above-referenced medical problems, promoting faster healing, reducing the amount of pain and the associated requirement for pain medications, improving the range of movement of the affected joint after recovery, and the like.

An early passive motion apparatus for knee surgery included a bicycle pedal arrangement. The pedals were driven by an appropriate drive means to flex the patient's knee.

Subsequently, more sophisticated apparatus were developed that could be used while the patient was still in bed. A super structure was fastened over the bed supporting a series of pulleys, a motor, and an adjustable lever arm driven by the motor. A rope extended from the lever arm around the pulleys and supported a sling positioned around the knee of the patient. As the motor drove the lever arm, the rope and sling arrangement lifted and lowered the knee. Among the drawbacks of this system was the relatively long set-up time required and the cumbersome nature of the apparatus.

Subsequently, simpler bed and floor supported apparatus were developed. In one, a motor driven worm gear drove a foot pedal toward and away from the patient. When the patient's foot was positioned adjacent the pedal, the pedal pushed and pulled on the patient's foot so as to raise and lower the patient's knee. One of the problems associated with the driven foot pedal apparatus was that the knee joint was subjected to undesirable compressive forces.

To alleviate compression of the knee, other apparatus were developed in which the worm gear drove an articulated leg supporting structure. A thigh supporting portion was connected to a calf supporting portion by a simple pivot. A follower on the worm gear selectively caused the thigh and calf portions to be pivoted upward and extended outward flexing the patient's knee therewith. One of the problems with the simply pivoted leg supporting structure was that the pivotable movement did not match the movement of the human knee. This mismatch in the movement of the knee and the leg supporting structure caused portions of the leg to slide or move longitudinally relative thereto. Moreover, the worm gear driven continuous passive motion exercise structures were relatively bulky and required relatively large storage areas between exercise sessions. The bulky size was particularly disadvantageous in relatively confined hospital rooms in which storage space was precious.

The present invention provides a new and improved continuous passive motion exercise apparatus which overcomes the above-referenced problems and others.

SUMMARY OF THE INVENTION

In accordance with one aspect of the present invention, a continuous passive motion exercise apparatus is provided. A patient bed includes a pair of oppositely disposed side rails and an upper patient supporting surface. A power module provides motive power for driving a patient joint flexing assembly to flex a joint of a patient supported by the patient supporting surface of the bed. A mounting assembly mounts the power module adjacent one of the bed side rails.

In accordance with a more limited aspect of the present invention, the mounting assembly is mounted directly to the bed side rails. In a bed in which the side rails are selectively movable to elevate the patient's head or feet, the exercise apparatus is able to be moved in synchronization with such elevation.

In accordance with a still more limited aspect of the present invention, the mounting assembly includes a transverse member which extends between the bed side rails and an upstanding post on which the power module is adjustably mounted. In the preferred embodiment, the power module is mounted such that its vertical position along the upstanding post is selectively adjustable. Moreover, the power module is mounted to swing about the central axis of the post to be swung away from the patient and out of the way between exercise sessions.

In accordance with yet another aspect of the present invention, the power module includes a motor for driving a generally horizontally disposed shaft through reciprocating angular displacement about a central axis of the shaft. A control circuit controls the angular displacement and the speed of the shaft. The control circuit includes an emergency shut-off and a malfunction sensor for terminating continuous passive motion exercise in response to a sensed malfunction.

In accordance with yet another aspect of the present invention, the patient joint flexing assembly includes a pivoted frame which is supported at one end by wheels or rollers which roll on a patient supporting surface of the bed. A polycentric pivotal connection connects the pivoted portions of the frame such that the frame flexes in the same mode of motion as the patient's knee.

In accordance with yet another aspect of the present invention, a plurality of joint flexing assemblies are provided for selective interconnection with the power module. The joint flexing assemblies may be particularly adapted for flexing the patient's knee, ankle, hip, elbow, wrist, or the like.

A primary advantage of the present invention is that it provides faster, more complete healing from joint surgery, reconstruction, replacement, injury and the like.

Another advantage of the present invention resides in the ease with which exercise sessions can be commenced and terminated. The exercise apparatus is readily swung to a self-storing position.

Yet another advantage of the present invention is that it is readily adapted to provide continuous passive motion exercise for any of a plurality of joints.

Still further advantages of the present invention will become apparent to those of ordinary skill in the art upon reading and understanding the following detailed description of the preferred embodiments.

BRIEF DESCRIPTION OF THE DRAWINGS

The invention may take form in various parts and arrangements of parts. The drawings are only for purposes of illustrating preferred embodiments of the invention and are not to be construed as limiting it.

DETAILED DESCRIPTION OF THE PREFERRED EMBODIMENTS

Figure 1:
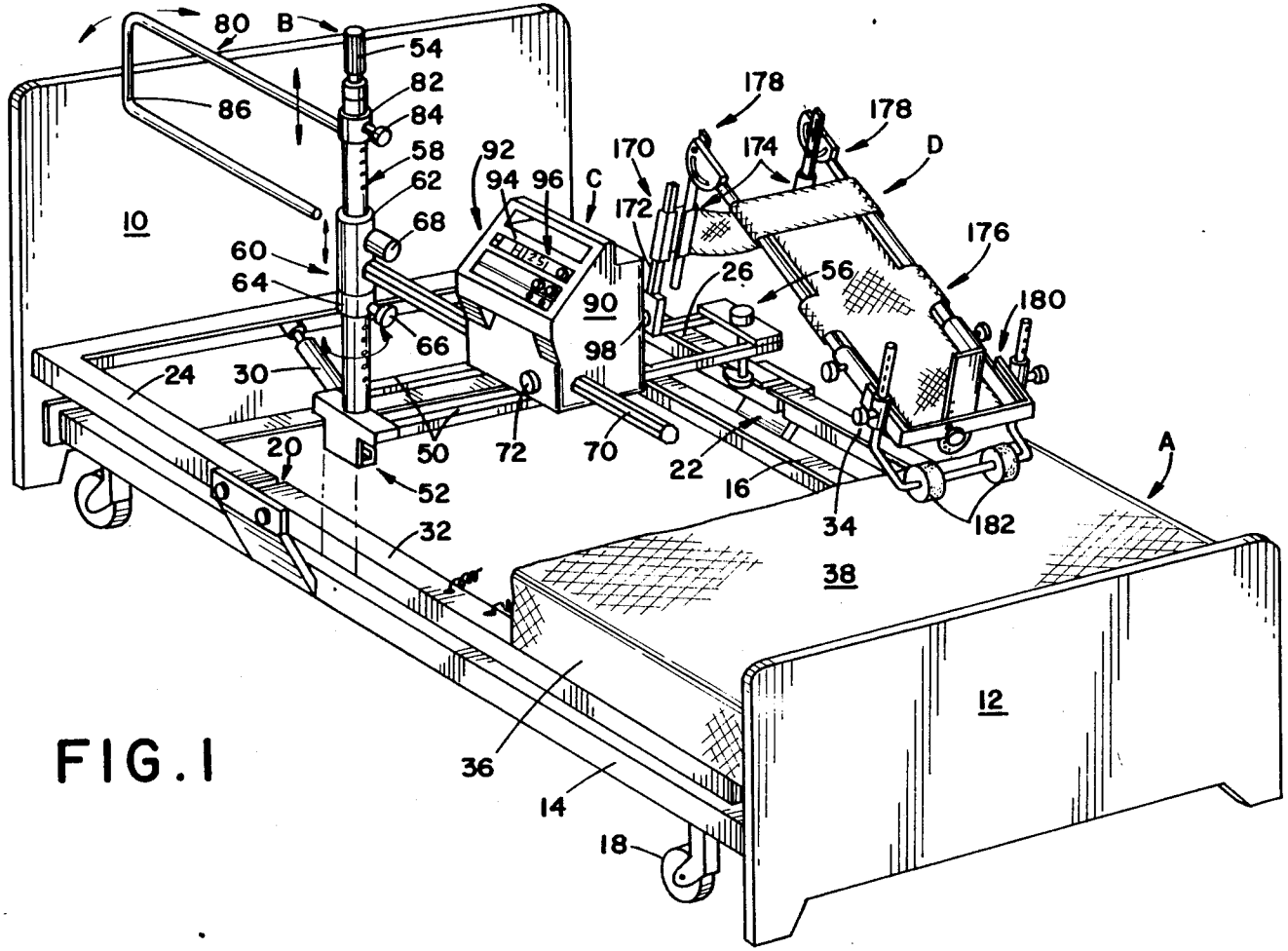
FIG. 1 is a partially exploded, perspective view of a continuous passive motion exercise apparatus in accordance with the present invention.

With reference to FIG. 1, a bed A selectively supports a patient who is to undergo continuous passive motion exercise therapy. A mounting assembly B selectively mounts a power module C adjacent one side of the bed. The power module provides motive power to a patient joint flexing assembly D to flex one or more joints of the patient supported on the bed. Although the joint flexing assembly illustrated in FIG. 1 is particularly adapted to flexing a patient's knee, joint flexing assemblies for other joints of the patient are readily interconnected to the power module.

The bed A includes a headboard 10, a footboard 12 and a pair of fixed side frame members 14, 16 rigidly connected between the headboard and the footboard. Casters 18 or other suitable ground supporting members support the bed on the ground.

To enable the patient to elevate his head and shoulders or his feet and legs, a patient elevating frame portion is provided. The elevating frame portion includes a pair of movable side rails 20, 22 which are movably mounted to the fixed side rails 14, 16. In particular, the movable side rails include patient head and upper body elevating portions 24, 26 which are connected for pivotal movement relative to the fixed side rail portions 14, 16. A linear motor 30, or other frame elevating means, is operatively connected between the fixed and movable frame portions for selectively pivoting the upper body elevating portion about its pivotal connection with the fixed side rails to elevate the patient's head. Analogously, leg elevating side rail portions 32, 34 are connected to pivot relative to the fixed side rails 14, 16 under the control of a linear motor (not shown) or the like for selectively elevating the patient's legs. A mattress 36 is supported by the patient elevating frame portions to provide a patient supporting surface 38.

In the embodiment of FIG. 1, the mounting assembly B includes relatively flat transverse members 50 which are configured to be supported by the side rails of the bed frame. A first clamping arrangement 52 is selectively clamped under the control of a knob 54 with one side rail of the bed and a second clamping arrangement 56 is selectively clamped to the opposite side rail of the bed frame. An upstanding or vertical post 58 is securely connected with the transverse members 50 to extend generally perpendicular to the bed side rail. The mounting assembly B is readily mounted to the bed by sliding the transverse members between the mattress and the frame and clamping the clamp arrangements 52 and 56 into tight engagement with the frame side rails.

A power module mounting means 60 adjustably mounts the power module C to the upstanding post 58. In the embodiment of FIG. 1, the module mounting means includes a sleeve 62 which is slidably disposed on the upstanding post to be selectively positioned vertically therealong and angularly thereabout. A swivel collar 64 rotatably supports the sleeve 62. A spring biased pin 66 selectively engages one of a plurality of apertures in the upstanding post for selectively adjusting the vertical position of the sleeve, hence of the power module. A tapered screw 68 extends threadedly through the sleeve 62 for locking the angular position of the sleeve relative to the upstanding post.

A power module mounting bar 70 is rigidly connected with the sleeve 62 such that the module mounting bar extends substantially parallel to the bed side rails when the tapered screw 68 is locked into engagement with one of the post apertures. The power module C is slidably mounted on the module mounting bar 70 and locked thereto by a clamping means 72.

In operation, the spring biased pin 66 is released enabling the power module to be positioned vertically to an appropriate height, generally closely adjacent the patient supporting surface 38. Upon fixing the vertical position of the power module, the tapered screw 68 is clamped down to fix the power module support bar 70 parallel to the side rail 20 of the bed. After the exercise session, the tapered screw 68 is released allowing the power module C and the joint flexing assembly D to be swung toward the head of the bed and out of the way until the next exercise session.

A patient guard rail assembly 80 is adjustably mounted to the upstanding post 58. The guard rail assembly includes a sleeve 82 which is slidably and rotatably mounted on the post. A spring biased pin 84 selectively locks the guard rail sleeve in a selected vertical and rotational position by engaging one of the apertures of the post 58. A generally U-shaped patient restraining bar 86 extends from the guard rail sleeve 82 generally perpendicular to the upstanding post. In operation, the guard rail assembly is selectively positioned over the post 58 and adjusted to an appropriate height. By releasing the guard rail spring pin 84, the guard rail may be selectively swung away and its height adjusted.

The power module C includes a housing 90 which is selectively mounted to the module mounting bar 70. A control panel 92 includes a display 94 for displaying information concerning the selection of exercise to be performed, exercise already performed, error or malfunction messages, and the like. A series of input switches or means 96 enable the operator to enter the appropriate control information to control the reciprocating oscillation of an outer motor shaft 98.

Figure 2A:
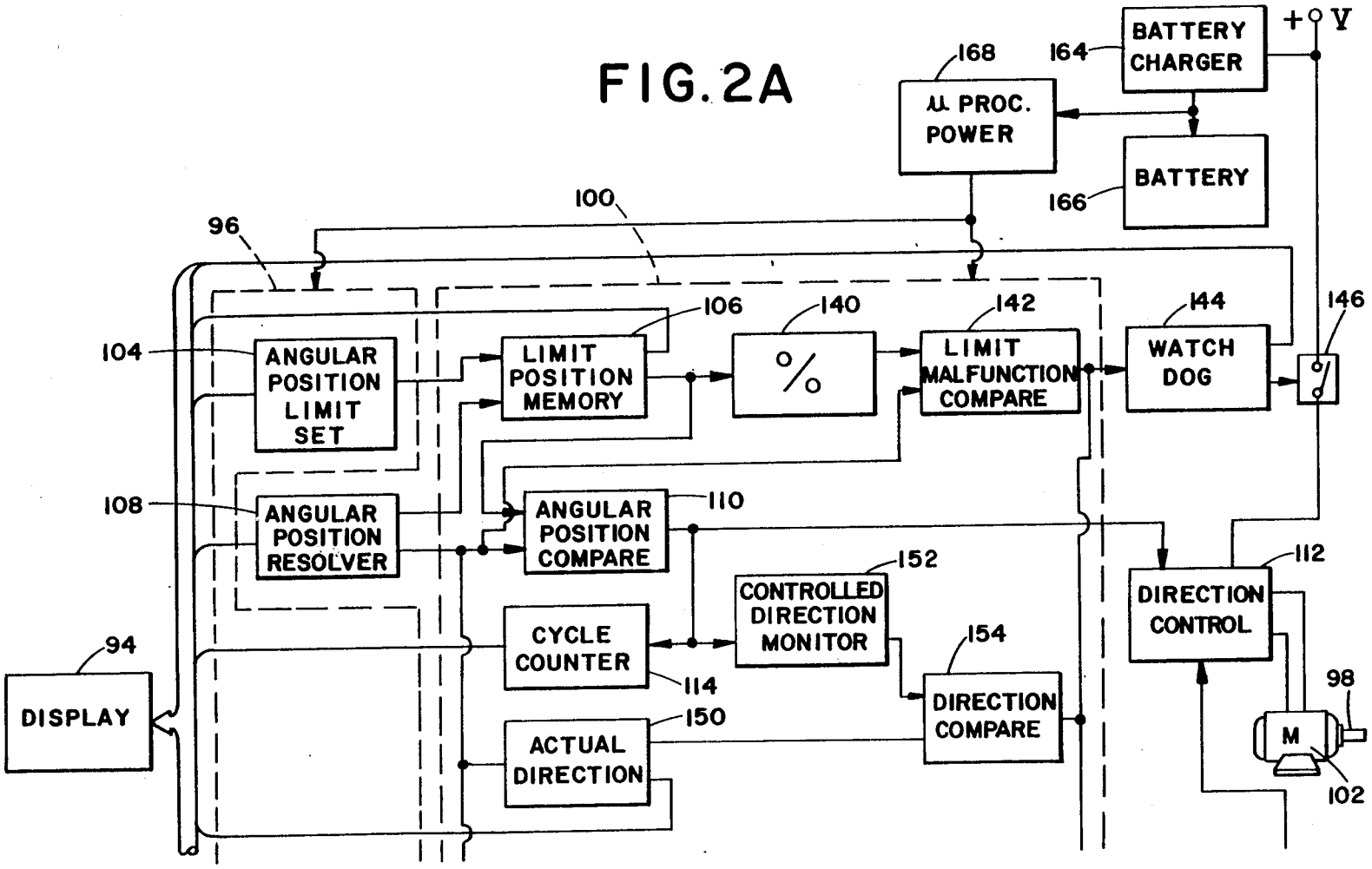
FIGS. 2A and B are a two part diagrammatic illustration of a control circuit for controlling kinetic motion with which the patient joint flexing assembly of FIG. 1 is driven.
Figure 2B:
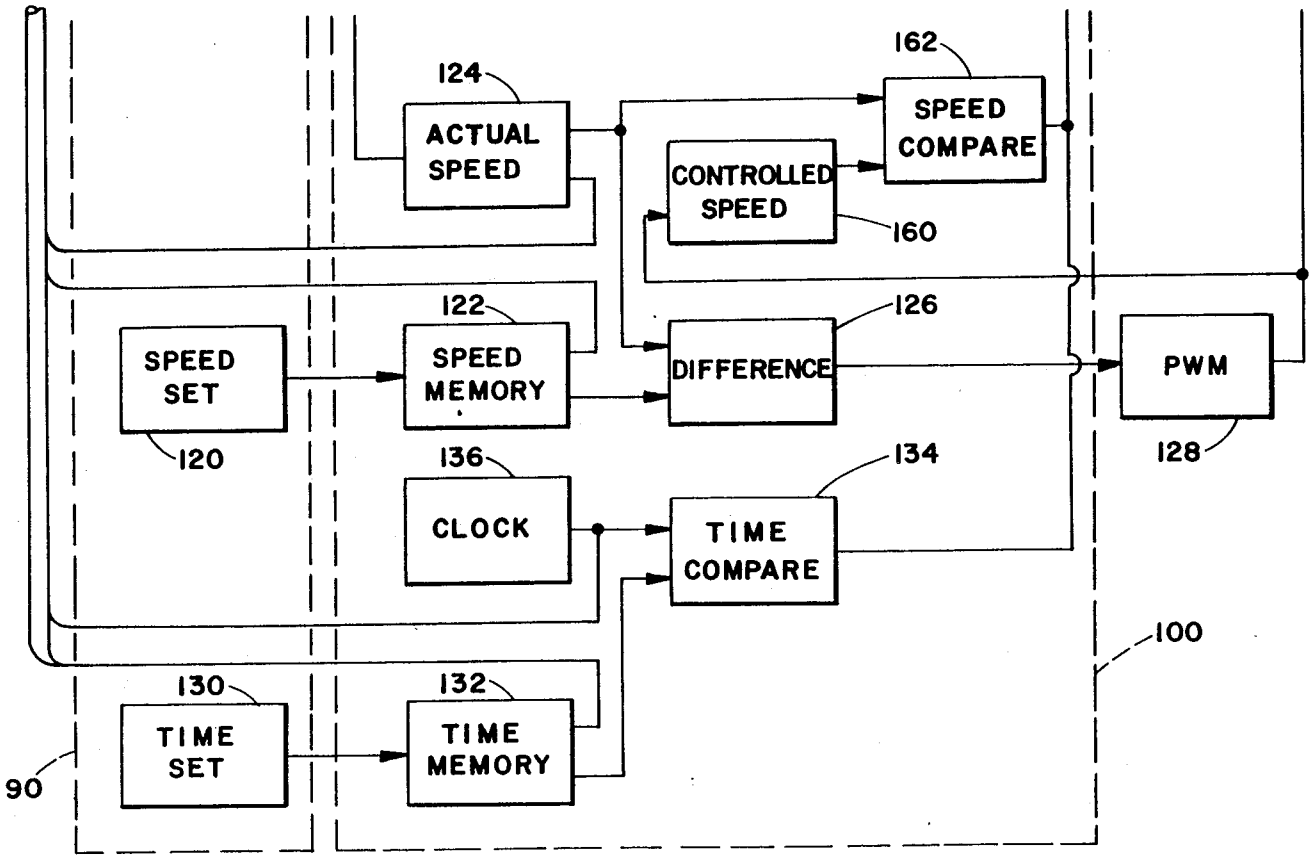

With particular reference to FIGS. 2A and B, the input switches 96 provide a microcomputer or processor 100 with selected exercise parameters. The microcomputer selectively controls a motor 102 which is connected with the output shaft 98 to cause the output shaft to oscillate at a selected speed and between selected angular position limits. In particular, the input switches include an angular position limit set switch 104 which selectively causes limits of the selected angular displacement to be stored in an angular displacement limit position memory 106. In the preferred embodiment, an angular position resolver 108 monitors the actual angular position of the shaft 98. Upon reaching the selected limits, the angular position limit set switch 104 causes the limit position memory 106 to store the current, actual shaft position. During exercise, an angular position comparing circuit 110 compares the selected angular position limits with the actual angular position of the shaft 98 and causes a direction control circuit 112 to reverse the motor each time a limit position is attained. A cycle counter 114 counts the oscillations of motor shaft 98.

The input switches 96 further include a speed selection switch 120 which causes a preselected angular velocity or speed for the shaft 98 to be stored in a speed or angular velocity memory 122. An actual speed circuit 24 differentiates the angular position signals from the angular position resolver 108 to determine the actual angular velocity of the shaft 98. A difference circuit 126 selectively controls a pulse width modulator 128 such that the width of electric power pulses supplied to the motor is varied so as to maintain the actual and selected speeds substantially the same.

A time selection switch 130 causes a time memory 132 to store a preselected duration over which exercise is to take place. A time compare means 134 compares the selected duration from the time memory with elapsed time from a clock circuit 136. At the end of the selected duration, the time compare means causes the supply of power to the motor to be terminated.

The microcomputer 100 further includes a plurality of malfunction sensing means for sensing various potential malfunctions. The malfunction sensing means include a means for sensing angular displacement beyond the selected angular displacement limits. An offset circuit 140 expands the selected angular position limits by a small offset or a percentage. An angular position malfunction comparing means 142 compares the actual resolver position with the expanded angular position limits and causes a watchdog circuit 144 to terminate power to the motor by opening a switch means 146 in response to the expanded limit positions being obtained.

The malfunction sensings means further include means for sensing a failure of the motor shaft 98 to change direction. An actual shaft rotation direction determing means 150 differentiates the angular position from the angular position resolver to determine the direction which the shaft 98 is rotating. A controlled direction monitor circuit 152 monitors the output from the angular position compare circuit 110 to determine the direction which the microprocessor has directed that the shaft rotate. If the microprocessor selected direction of rotation and the actual direction of rotation failed to match, a direction comparing means 154 causes the watchdog circuit 144 to terminate the supply of power to the motor.

The malfunction sensing means further includes means for sensing a failure of the shaft 98 to rotate at the selected angular velocity. Such a failure may, for example, be attributable to a broken drive belt or a mechanical linkage between the motor and the shaft. A controlled speed circuit 160 is connected with the pulse width modulator 128 to determine the speed with which the microcomputer is directing that the motor to rotate the shaft. A speed comparing circuit 162 compares the actual angular velocity as determined by the actual speed circuit 124 with the controlled angular velocity from the controlled speed circuit 160. If the two angular velocities fail to maintain substantial coincidence, the speed comparing circuuit 160 causes the watchdog circuit 144 to terminate the supply of power to the motor.

Optionally, the angular position set switch 104, the angular position resolver 108, the speed selection memory 122, the actual speed determining circuit 124, the time memory 132, the clock 136, the watchdog circuit 144, and the actual direction determining circuit 150, may be interconnected with the display means 94 for displaying the selected angular position limits for the shaft 98, the actual angular position, speed, and direction of the shaft 98, the selected speed for the shaft 98, the actual duration of exercise, the selected duration for exercise, and displays indicitive of various malfunction conditions.

To maintain the set conditions when the control module is unplugged, a battery backup is provided. A battery charger 164 recharges a battery 166 when the control module is connected with a source of electrical power. A microcomputer power supply 168 draws electric power from the battery charger 164 or the battery 166 to provide electrical power to the microcomputer 100.

Referring again to FIG. 1, the joint flexing assembly D includes a quick connect and disconnect mounting bracket 170 for facilitating ready interconnection and disconnection with a lever arm 172 which is rigidly connected with motor shaft 98. In the knee exercising embodiment illustrated in FIG. 1, the joint flexing assembly includes a thigh supporting portion 174 and a calf supporting portion 176 which are pivotally connected by polycentric hinge assemblies 178. An ankle supporting structure 180 is adjustably connected with one end of the calf supporting portion. A support 182, such as a pair of rollers, movably supports the free end of the joint flexing assembly on the patient supporting surface 38 of the mattress.

In operation, the mounting assembly B is adjusted until the drive shaft 98 is aligned with the axis of the patient's hip. The length of the thigh support portion 174 is selectively adjusted such that the polycentric hinges 178 align with the patient's knee. The length of the calf supporting portion 176 and the ankle support 180 are adjusted to support the patient's calf and ankle. As the shaft 98 oscillates, the patient's knee is cyclically drawn upward and lowered downward as the rollers 182 roll back and forth along the patient supporting surface of the mattress.

Figure 3:
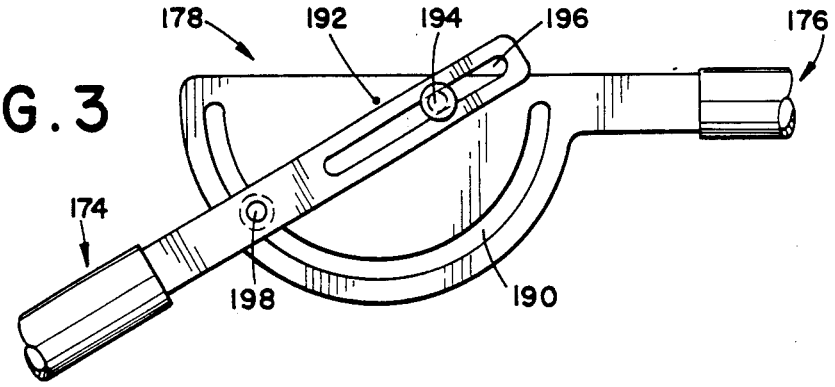
FIG. 3 is a detailed view of a polycentric joint structure of the patient joint flexing assembly of FIG. 1.

With particular reference to FIG. 3, each polycentric hinge 178 includes a guide track 190 which extends along a circular arc segment having a geometric center at 192. A pivot pin 194 is mounted off the geometric center 192 of the arcuate guide track 190. A linear guide track 196 slidably receives the off center pivot pin 194. A follower pin 198 rides in the arcuate guide track 190. In this manner, the center of rotation about which the calf and thigh portions rotate continuously shifts as the knee is flexed.

Figure 4:
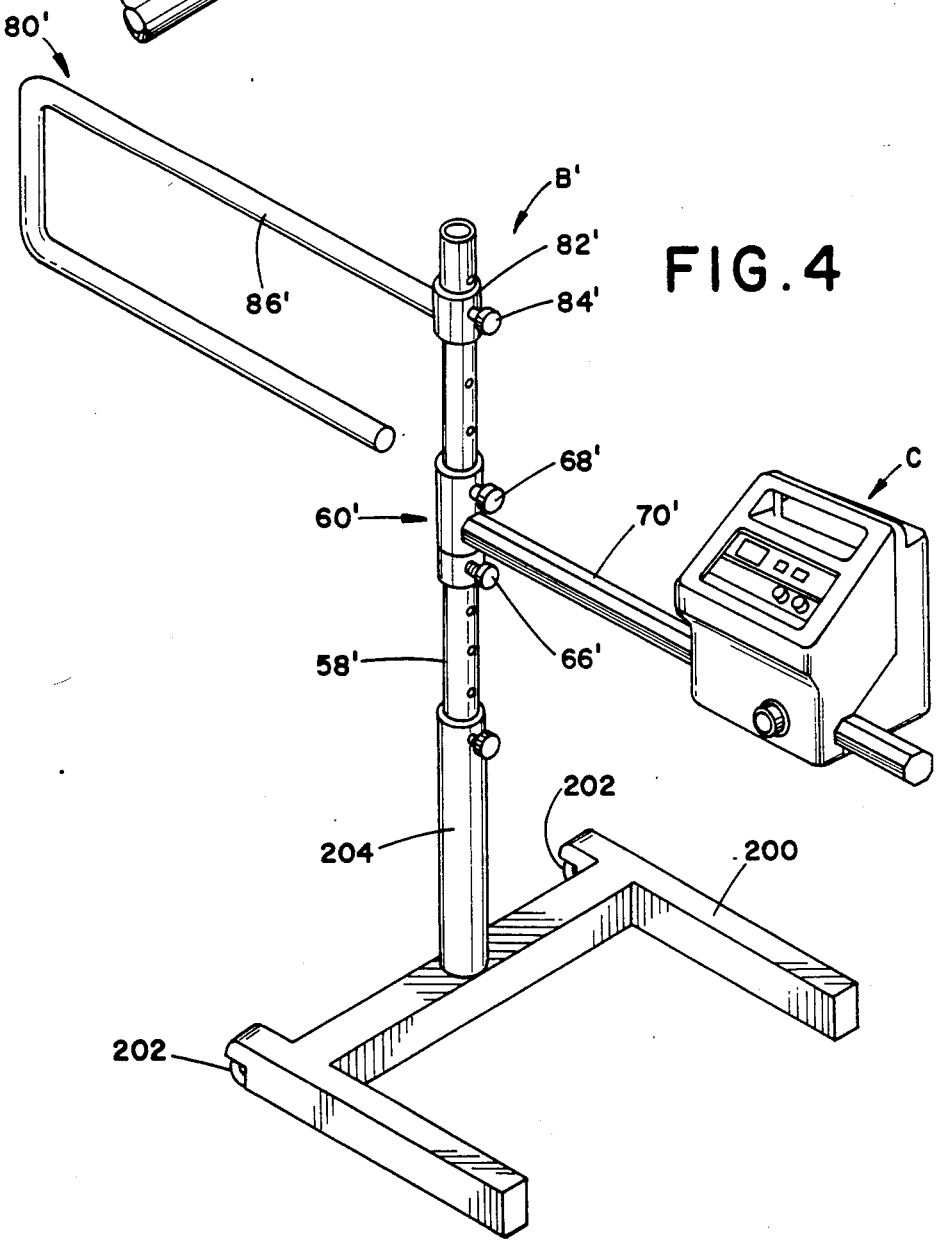
FIG. 4 is an alternate embodiment of a power module mounting assembly in which the power module is mounted on a movable stand; and, FIG. 5 is a perspective view of a patient joint flexing assembly which is particularly adapted for flexing the elbow and other joints of the patient's arm.

In the alternate embodiment of the mounting assembly B illustrated in FIG. 4, like elements with the emboiment of FIG. 1 are denoted by the same reference numerals but followed by a primed suffix (′). The mounting assembly B includes a U-shaped, floor engaging structure 200 for resting firmly on the floor. A pair of rollers 202 or the like facilitate movement of the stand to a position adjacent the side rails of the patient bed, storage locations, and the like. A lower post member 204 is rigidly connected with the U-shaped floor engaging structure for telescopically receiving an upstanding post 58′ therein.

A module mounting means 60′ is mounted on the upstanding post 58′ for selectively positioning the power module C. A spring biased pin 66′ and a tapered locking screw 68′ selectively engage apertures in the upstanding post 58′ to lock the vertical and angular position of module mounting means. In this manner, a drive module mounting bar 70′ is selectively positioned relative to the bed.

An adjustable guard rail assembly 80′ is adjustably mounted on the upstanding post 58′. A guard rail member 86′ is connected with a slidable sleeve 82′ which is rotatably and slidably mounted on the upstanding post 58′. A spring pin 84′ selectively locks the guard rail assembly in a selected vertical position.

Figure 5:
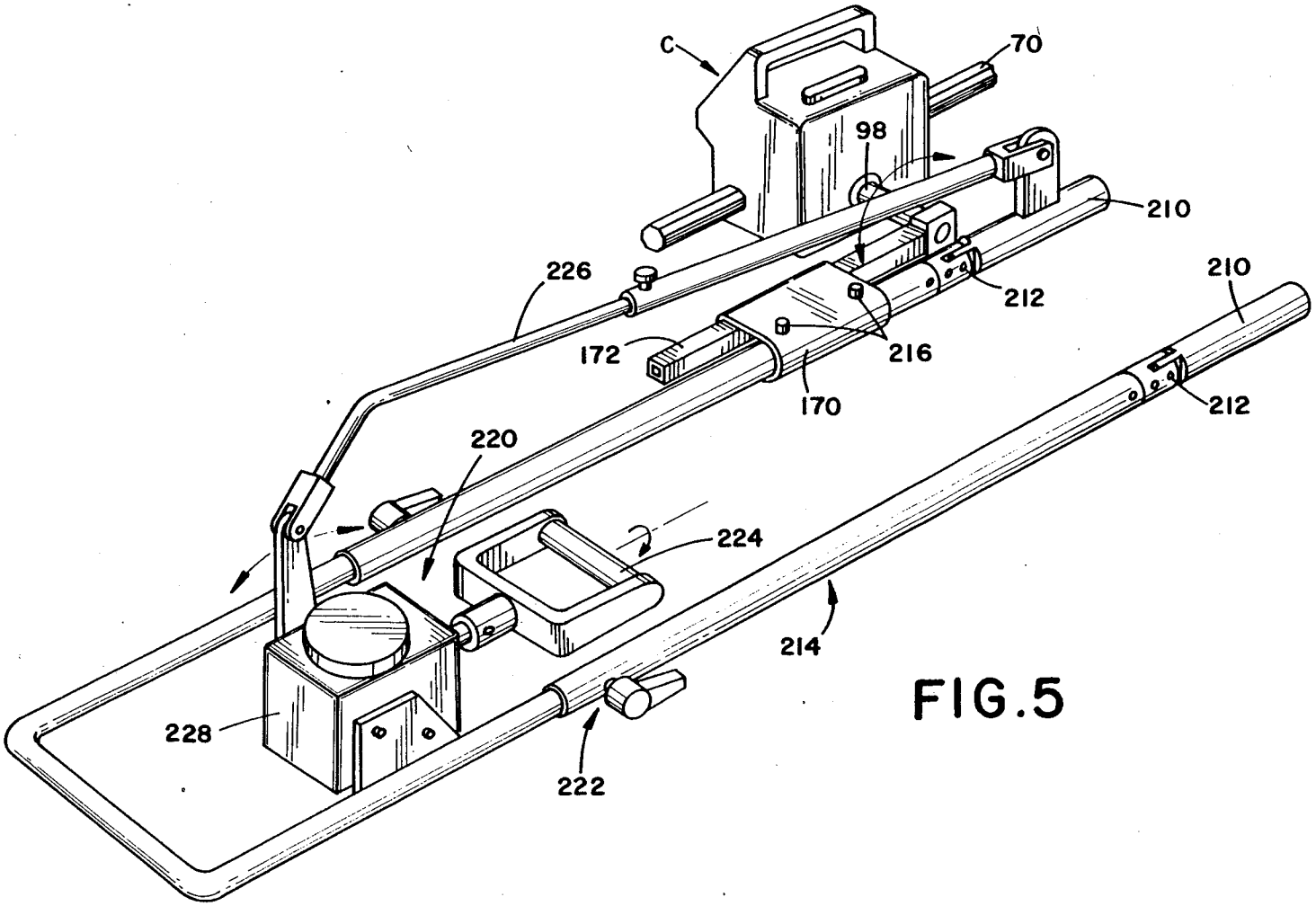

FIG. 5 illustrates a joint flexing assembly D which is particularly adapted for flexing the patient's wrist and elbow. The joint flexing assembly D includes a first portion 210 which is connected by a simple hinge 212 with a forearm supporting portion 214. Normally, the first portion 210 rests on the patient supporting surface 38 of the mattress and the hinge 212 is disposed in axial alignment with the drive shaft 98. Mounting pins 216 are disposed on the forearm supporting portion to facilitate ready interconnection with the quick connect mounting bracket 170.

A wrist flexing assembly 220 is connected with the forearm supporting portion by an adjustable connection 222 for adjusting the effective length of the forearm portion. The wrist flexing assembly includes a grip member 224 which is to be grasped in the hand of the patient. A drive rod 226 selectively provides rotational driving power to a gear box 228 in coordination with the flexing of the forearm support portion about the hinge 212. The gear box 228 rotates the grasping means 228 about a horizontal axis in coordination with the flexing of the elbow. The rotation of the wrist, may be linear or non-linear with flexing of the elbow as may be appropriate to the treatment prescribed.

The invention has been described with reference to the preferred embodiment. Obviously, alterations and modifications will occur to others upon reading and understanding the preceeding detailed description. It is intended that the invention be construed as including all such alterations and modifications in so far as they come within the scope of the appended claims or the equivalents thereof.

Having thus described the preferred embodiment, the invention is now claimed to be:

1. A passive motion exercise apparatus for use with a bed which has oppositely disposed frame side rails and a mattress which is supported between the side rails, the exercise apparatus comprising:

a drive means for driving a drive shaft through oscillating angular displacement, the drive shaft being displaced through an angle of less than 180° about a longitudinal axis of the drive shaft;

a post assembly which is selectively mounted along one of the bed side rails and extending upward from the one side rail, the drive shaft being mounted to the post assembly such that the drive shaft longitudinal axis is selectively positionable in alignment with an axis of one selected joint of a patient supported on the mattress;

a control circuit for controlling at least the limits of the angular displacement and speed of the angular displacement of the drive shaft, the control circuit being operatively connected with the drive means; and, a patient joint flexing assembly for flexing a patient's joint, the joint flexing assembly includes a pivoted frame which is supported at one end by the drive shaft and is movably supported at an opposite end by a rolling means adapted to be directly supported on the mattress such that the opposite end of the frame moves back and forth on the mattress as the drive shaft oscillates.

2. The exercise apparatus as set forth in claim 1 wherein the control circuit includes a malfunction sensing means for stopping movement of the drive shaft in response to a sensed malfunction.

3. The exercise apparatus as set forth in claim 2 wherein the malfunction sensing means senses angular displacement of the drive shaft beyond preselected limits.

4. The exercise apparatus as set forth in claim 2 wherein the malfunction sensing means senses a failure of the drive shaft to change angular displacement direction.

5. The exercise apparatus as set forth in claim 2 wherein the malfunction sensing means senses a failure of the drive shaft to be angularly displaced at the selected speed, whereby the exercise is terminated in response to the drive shaft rotating too fast, too slow, or becoming stalled.

6. A passive motion exercise apparatus for use with a bed which has oppositely disposed frame side rails and a mattress supported between the side rails, the exercise apparatus comprising:

a post which is fixedly mountable in a vertical orientation along one of the bed side rails;

a mounting bar extending outward horizontally from the post;

a mounting connection means:

(i) for connecting the mounting bar assembly to the vertical post such that the mounting bar assembly is selectively rotatable about the post in a generally horizontal plane, (ii) for selectively adjusting the horizontal plane, and (iii) for selectively locking the mounting bar against rotation in a position parallel to the bed side rail;

a swing-away guard rail;

a guard rail mounting means for mounting the guard rail to the post independently from and above the mounting bar such that the guard rail is rotatable about the post and vertically adjustable along the post, whereby the guard rail may be adjusted in height and selectively swung away from the bed independently of the mounting bar;

a power module including a drive motor and a control circuit for adjustably controlling the drive motor;

a power module mounting means for selectively mounting the power module to the mounting bar at a selectable distance from the post therealong;

a patient joint flexing assembly for flexing a patient's joint, the joint flexing assembly being selectively mounted to the power module to receive driving power from the drive motor and to be moveably supported in part on the mattress and in part by the power module when the mounting bar is locked in the position parallel to the bed side rail and to be supported completely by the power module when the mounting bar assembly is rotated about the post away from the bed side rail.

7. The exercise apparatus as set forth in claim 6 further including a transverse member which extends from the post and is connected between the bed frame side rails.

8. The exercise apparatus as set forth in claim 6 wherein the patient joint flexing assembly includes a thigh supporting frame portion and a calf supporting frame portion interconnected by a polycentric hinge, and a rolling means adapted for moveably supporting the calf supporting portion on the mattress.

9. The exercise apparatus as set forth in claim 6 further including a floor engaging stand which is operatively connected with a lower end of the post, whereby the post is supported at least in part by the floor.

10. A passive motion exercise apparatus for use in conjunction with a bed which has oppositely disposed side rails and a patient supporting mattress which is mounted between the bed side rails, the exercise apparatus comprising:

a calf supporting portion extending longitudinally between a first end and a second end, the calf supporting portion second end having a means adapted to be moveably supported directly on a top surface of the mattress for back and forth motion in a longitudinal direction along the mattress top surface;

a thigh supporting portion extending longitudinally between a first end and a second end, the thigh supporting portion first end being rotatable about a transverse axis;

a hinge means for pivotally connecting the calf supporting portion first end and the thigh supporting portion second end; and, a power module for reciprocating the thigh supporting portion back and forth about the transverse axis such that the calf supporting portion is moved back and forth along the mattress top surface.

11. The exercise apparatus as set forth in claim 6 further including:

a plurality of patient joint flexing assemblies, each joint flexing assembly for selectively flexing a preselected patient joint, each of the patient joint flexing assemblies being selectively interconnectable with the power module to be driven thereby.

12. The exercise apparatus as set forth in claim 11 wherein one of the patient joint flexing assemblies includes a patient forearm supporting frame portion, a patient hand supporting portion, and means for selectively rotating the patient's hand and wrist relative to the forearm.

13. A passive motion exercise apparatus comprising:

a bed including a pair of oppositely disposed side rails, a patient supporting surface mounted therebetween, a means for tipping a corresponding portions of the oppositely disposed side rails and the patient supporting surface disposed therebetween for selecting canting at least a portion of a patient supported on the patient supporting surface;

a mounting assembly for clamping a post assembly to the selectively tipped portion of at least one of the side rails, such that the post assembly is canted with the side rails;

a power module for providing motive driving force;

a power module mounting means for mounting the power module to the post assembly such that the power module is canted with the side rails and the patient supporting surface; and, a patient joint flexing assembly for selectively flexing a patient's joint, the joint flexing assembly being operatively connected with the power module to be supported thereby and to receive motive power therefrom, such that the patient supported on the patient supporting surface and the joint flexing assembly move together as the bed side rails and patient supporting portion are selectively canted, whereby the canting of the bed is selectively adjustable during an exercise session without misaligning the patient and the joint flexing assembly.

14. The exercise apparatus as set forth in claim 13 further including a plurality of patient joint flexing assemblies which are selectively interconnected with the power module, the patient joint flexing assemblies each being particularly adapted to the flexing of a selected patient joint.

15. The exercise apparatus as set forth in claim 13 wherein the patient joint flexing assembly includes a pivoted frame which is operatively connected with the power module and a means for movably supporting at least a portion of the frame on the patient supporting surface of the bed.

16. The exercise apparatus as set forth in claim 15 wherein the pivoted frame includes a thigh supporting frame portion which is moved with the drive shaft, a calf supporting frame portion which is operatively connected with the ambulating means, and a polycentric hinge means for operatively connecting the thigh and calf supporting frame portions.

17. A passive motion exercise apparatus for use in conjunction with a bed which has oppositely disposed side rails and a patient supporting mattress which is mounted between the bed side rails, the exercise apparatus comprising:

a thigh supporting frame portion which is mounted to a power module to be reciprocally driven about a horizontal axis by the power module between a generally horizontal position and a raised position, the thigh supporting frame portion being supported adjacent one end by the power module and extends generally transversely to the horizontal axis;

a calf supporting frame portion which is operatively connected at one end with the thigh supporting frame portion by a polycentric hinge means;

one of the thigh and calf supporting frame portions defines an arcuate guide track therein and has a pivot pin mounted thereto off center from a geometric center of the arcuate guide track and wherein the other of the thigh and calf supporting frame portions defines an elongated guide track which slidably receives the pivot pin and which has a follower mounted thereon which is slidably received in the arcuate guide track, whereby the polycentric hinge simulates the lengthening of a patient's knee joint as the patient's leg is extended.

18. The exercise apparatus as set forth in claim 13 wherein the patient joint flexing assembly includes a patient forearm supporting frame portion operatively connected adjacent a first end with the power module, a patient hand supporting portion, and means for selectively rotating the patient's hand and wrist relative to the forearm, the rotating means being operatively connected with the hand supporting portion and operatively connected adjacent a second end of the forearm supporting frame portion.

* * * * *